United States Patent [19]

Urbank

[11] 4,195,546

[45] Apr. 1, 1980

[54] CHORD SELECTOR

[76] Inventor: Stanley Urbank, 104 Morton St., New Eagle, Pa. 15067

[21] Appl. No.: 15,121

[22] Filed: Feb. 26, 1979

[51] Int. Cl.[2] ..... G10D 3/04

[52] U.S. Cl. ..... 84/318; 84/315

[58] Field of Search ..... 84/315-319, 84/312 R

[56] References Cited

U.S. PATENT DOCUMENTS

| | | | |
|---|---|---|---|
| 759,850 | 5/1904 | Battram | 84/318 X |
| 1,518,719 | 12/1924 | Whiteman | 84/318 |
| 1,616,859 | 2/1927 | Johnston | 84/318 |

FOREIGN PATENT DOCUMENTS

| | | | |
|---|---|---|---|
| 344106 | 10/1904 | France | 84/318 |

*Primary Examiner*—Lawrence R. Franklin

*Attorney, Agent, or Firm*—Buell, Blenko & Ziesenheim

[57] ABSTRACT

A chord selector is used on a stringed instrument such as a guitar. The selector has a body portion adapted to fit over the head end and a plurality of flexible curved arms. Each arm is movable over a base and through a passageway and has a tip projecting over a string. Each resilient arm opposes a straightening deformation caused by the body portion by pressing the tip against the string.

3 Claims, 3 Drawing Figures

CHORD SELECTOR

The invention relates to chord selectors for stringed musical instruments such as a guitar and the like.

The basic technique of playing a guitar requires the player to press the strings to the frets on the neck with the left hand to hold the chord while the right hand plays the melody over the sounding board. However, even this technique is difficult and the amateur guitarist can effectively chord and play melody only with considerable practice and effort. Hence, various chording attachments have been developed to fit over the neck of the guitar which permit the player to preselect the chord and then to concentrate on playing the melody. Such devices comprise several interconnected wheels lying across the neck of the guitar and having projections for contacting the strings. An indexing wheel is manually set to a chord and operatively interconnected wheels rotate for extending the appropriate projections against the strings. Such devices are too complicated; although they may appear to be easily utilized, practically speaking they cannot be used effectively where a string is not in tune or where the player prefers a variation on the chord.

I have invented a new and different chord selector. With my invention the player merely preselects the chord of each string separately from the others. I employ novel means for attaching the selector to the head end of a guitar and projecting string-depressing elements over the strings. The chord selector of the present invention comprises a plurality of flexible string-depressing arms slidably supported by a body. The body includes a base portion having an upper surface superposed above the head of the instrument, a leg portion for supporting the base above the head, and a raised portion on the upper surface of the base adjacent one end thereof and having a row of passageways. Each arm has a tip end and is curved for yieldingly contacting the upper base surface and the ceiling surface of a passageway when the tip end presses on a string. The inherent resilience of the arm opposing its straightening deformation between the upper surface of the base and the ceiling surface of the passageway urges the tip end of the bar against the string. I prefer to provide a fastening means such as an elastic strap or the like fixed over the length of the raised portion and around the stringed instrument for firmly holding the raised portion of the body to the instrument.

Other details, objects, and advantages of the invention will become apparent as the following description of a present preferred embodiment thereof proceeds.

In the accompanying drawings, I have shown a present preferred embodiment of the invention in which.

Figure 1:
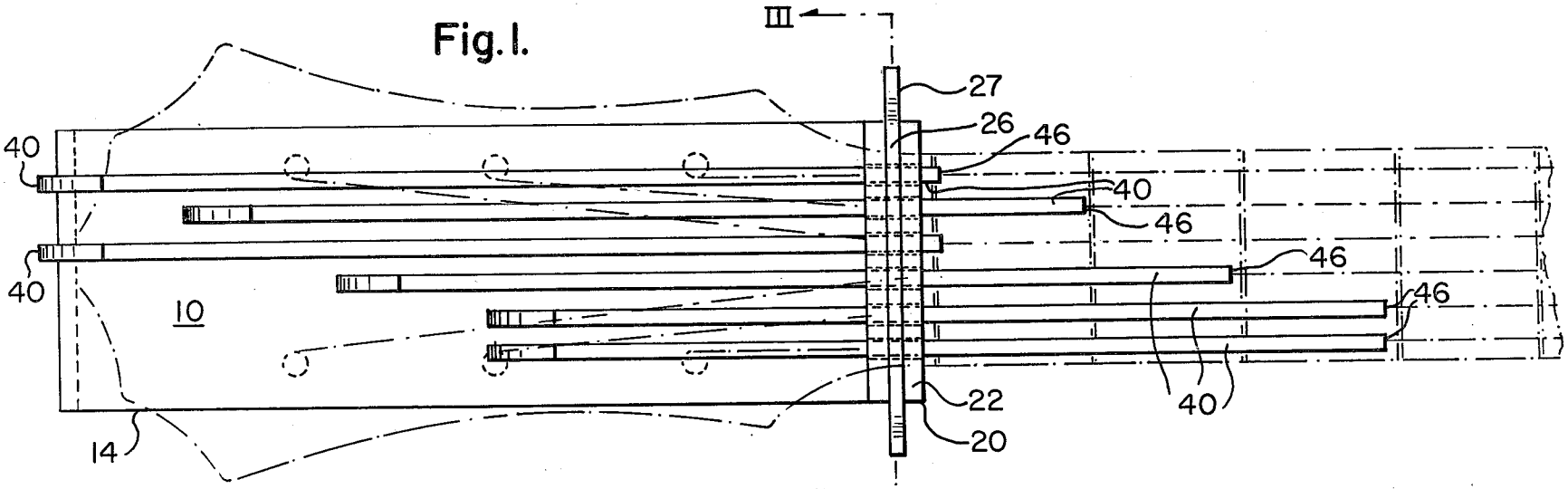
FIG. 1 is a plan view of a chord selector.
Figure 2:
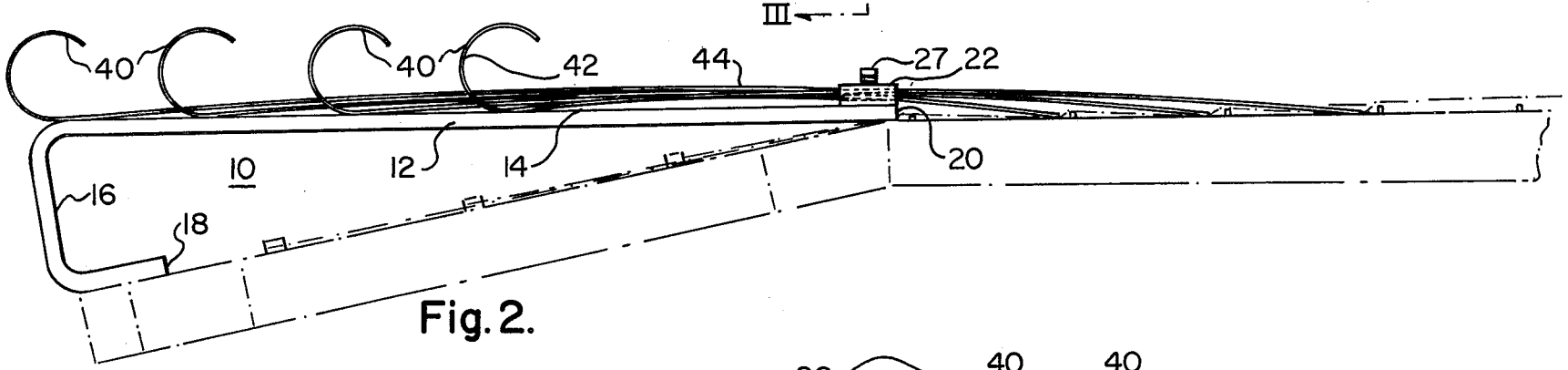
FIG. 2 is a side view of the chord selector shown in FIG. 1.
Figure 3:
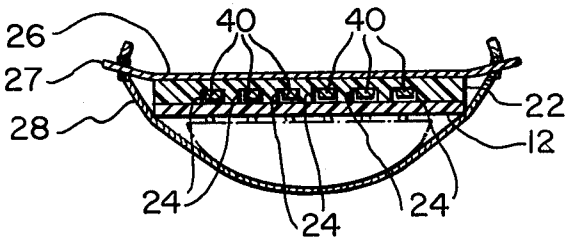
FIG. 3 is an end view of the body of the chord selector shown in FIG. 1 taken along the line III—III.

Referring to the drawings, the chord selector comprises a body 10 disposed above the head of a stringed instrument such as a guitar for slidably supporting a plurality of flexible arms 40.

The body 10 has a base portion 12 adapted to be superposed above the instrument head with its upper surface 14 substantially parallel to the plane of the neck. The base 12 is supported by leg 16 having foot section 18 resting on the head and by base end 20 resting on the portion of the head adjoining the neck. Adjacent end 20 on upper surface 14 is raised portion 22 having a row of passageways 24 adapted to hold the flexible arms 40. I prefer to form the base portion 12 and leg portion 16 from one material and then to fix the raised portion 22 to the upper surface 14 with an adhesive substance; although, the body 10 may also be formed in one piece. A transverse bar 26 is affixed across the top of the raised portion 22 with a suitable adhesive.

I provide a fastening means such as an elastic strap 28 for holding the raised portion 22 of the body 10 to the head end. The strap has eyelets 30, and 30 disposed along its length to receive the extending ends 27 of transverse bar 26 when the strap 28 is wound around the head and the body 10.

The flexible arms 40 are adapted for yieldingly contacting the body 10 when tip ends 46 press up on the instrument strings. Each arm 40 also has a compound curved portion including a first coiled section 42 for presenting a smooth surface to the upper base surface 14 of the base 12 and for providing a convenient grasp by which the arm 40 can be positioned and a second arched section 44 adapted for sliding along the ceiling of a passageway. Thus the spring of the flexible arms 40 urges the tip end onto the strings. The arms 40 are preferably made of spring steel, but any flexible material which can resiliently hold the tip end 46 firmly upon the strings will be suitable. Tip ends 46 are grooved to present a surface to the strings; however, a smooth surface may be added to the tip ends 46 for contacting the strings.

In the practice of my invention, I attach the body 10 to the head of the instrument with fastening means 28. The arched sections 44 of the arms 40 yieldingly contact the ceiling of the passageways in the raised portion and become a fulcrum. The spring-like force with the arms 40 urges the coiled sections 42 against the base 12 and urges the tip ends 46 against the strings. I prefer to provide a flexible base 12 with a leg portion 16 which can be biased against the head by the spring-like force of arm 40.

The player may position arms 40 and tip ends 46 to the appropriate location and preselect the chord before playing.

While I have shown and described a present preferred embodiment of the invention, it is to be distinctly understood that the invention is not limited thereto but may be otherwise variously embodied within the scope of the following claims.

I claim:

1. A chord selector for a stringed musical instrument comprising:

(a) a body adapted to lay on the head of the instrument and (b) a plurality of flexible arms supported by the body, each being separately slidable along the length of the associated string, and (i) having a tip end for pressing on a string and (ii) adapted for yieldingly contacting the body when the tip end presses on a string.

2. The chord selector of claim 1 wherein the body has:

(i) a base portion having an upper surface adapted to be superposed above the head of the instrument, (ii) a leg portion on the upper surface adjacent one end of the base and having a row of passageways and wherein the flexible arms have a first curved section for contacting the upper surface of the base and a second curved section for contacting the ceiling of a passageway when the tip end presses on a string.

3. The chord selector of claim 2 further comprising a fastening means for holding the raised portion of the body to the head.

* * * * *